United States Patent [19]

Beehler

[11] Patent Number: 4,865,517

[45] Date of Patent: Sep. 12, 1989

[54] BLOWER WITH CLAM SHELL HOUSING

[75] Inventor: Richard F. Beehler, Franklin, Tenn.

[73] Assignee: Heil-Quaker Corporation, Lavergne, Tenn.

[21] Appl. No.: 217,761

[22] Filed: Jul. 11, 1988

[51] Int. Cl.[4] ..... F04D 29/40

[52] U.S. Cl. ..... 415/214.1; 277/205

[58] Field of Search ..... 415/219, 219 C, 206, 415/214, 197, 170 R, 173 R, 174; 417/423.14, 424.1; 277/205; 220/378; 285/331, 373

[56] References Cited

U.S. PATENT DOCUMENTS

| | | | |
|---|---|---|---|
| 1,707,719 | 4/1929 | Goldthwaite | 415/219 R |
| 2,784,675 | 3/1957 | Farrell | 285/321 |
| 2,967,014 | 1/1961 | Pabst | 415/214 |
| 2,967,487 | 11/1961 | Nagely | 418/134 |
| 3,105,446 | 10/1963 | Blomgren St., et al. | 418/189 |
| 3,134,334 | 5/1964 | Smith | 418/26 |
| 3,373,693 | 3/1968 | McKittrick | 418/13 |
| 3,689,931 | 9/1972 | Fortis | 415/202 |
| 3,773,432 | 11/1973 | Chow et al. | 415/152 A |
| 3,859,014 | 1/1975 | Dworak et al. | 418/135 |
| 3,953,146 | 4/1976 | Sowards | 416/241 A |
| 4,111,618 | 9/1978 | Thibault | 418/152 |
| 4,298,204 | 11/1981 | Jinkins | 220/378 |
| 4,408,964 | 10/1983 | Mochizuki et al. | 417/310 |
| 4,538,971 | 9/1985 | Miller | 417/423.2 |
| 4,542,734 | 9/1985 | Trent et al. | 126/110 R |
| 4,599,042 | 7/1986 | Colliver | 415/219 R |
| 4,660,869 | 4/1987 | Gabus | 285/331 |
| 4,699,293 | 10/1987 | Duchrow | 220/3.8 |
| 4,773,823 | 9/1988 | Pease | 415/177 |

FOREIGN PATENT DOCUMENTS

| | | | |
|---|---|---|---|
| 897645 | 4/1953 | Fed. Rep. of Germany | 220/378 |

*Primary Examiner*—Robert E. Garrett
*Assistant Examiner*—John T. Kwon
*Attorney, Agent, or Firm*—Jeffers, Hoffman & Niewyk

[57] ABSTRACT

A plastic blower including a clam shell housing. The clam shell members of the housing are sealed together by means of a groove in the edge of one of the clam shell members and a tongue formed on the edge of the other clam shell member. A strip of flexible sealing material is disposed in the groove and is compressed therein by engagement with the protruding tongue. The spaced between the tongue and the walls of the groove converges toward the open end of the groove, whereby an increase or decrease of pressure within the housing relative to the ambient pressure causes the sealing strip to be further wedged into the space, thereby increasing the effectiveness of the seal.

12 Claims, 5 Drawing Sheets

BLOWER WITH CLAM SHELL HOUSING

BACKGROUND OF THE INVENTION

This invention pertains to blowers and more particularly to a blower with a clam shell housing for handling hot corrosive gases and liquids.

Furnaces, such as those used for heating residences, are sometimes equipped with exhaust blowers which draw the hot products of combustion through one or more heat exchangers and then exhaust the products of combustion to a flu or a vent. In the use of such blowers, a substantial amount of heat is scrubbed from the products of combustion so that the temperature of the products of combustion, after passing through the heat exchangers, is approximately 100° F. The products of combustion contain carbon monoxide, carbon dioxide, as well as corrosive substances. Furthermore, the products of combustion contain a large amount of water vapor which condense in the system and, by combining with the corrosive substances, may create a highly corrosive environment for the system including the blower. It is therefore important that such an exhaust blower be able to withstand the corrosive products of combustion as well as the acidic water which condenses from the products of combustion. Furthermore, it is important that such exhaust blowers be effectively sealed so that no gases will escape therefrom.

Prior art exhaust blowers have not been totally satisfactory. Such blowers have often included stainless steel parts to withstand the corrosive environment and furthermore have been assembled by means of threaded fasteners and the like to create a sealed blower housing. The cost of such blowers has therefore been rather prohibitive and furthermore the life of such blowers has not been altogether satisfactory.

It is therefore desired to provide an exhaust blower that is able to withstand the corrosive furnace environment. It is furthermore desired to provide such a blower which is effectively sealed to prevent escape of products of combustion from the blower and furthermore which is assembled without the use of threaded fasteners and the like.

Lastly, it is desired to provide such a blower which is constructed virtually completely out of plastic.

SUMMARY OF THE INVENTION

The present invention, in one form thereof, overcomes the disadvantages of the above described prior art exhaust blowers by providing an improved blower therefor. The blower, according to the present invention, comprises two clam shell housing sections which are secured together by means of spring clips. Furthermore, the edges of the clam shell housing sections are provided with a tongue and groove structure with a sealing strip disposed in the groove whereby the tongue compresses the sealing strip. Furthermore, the space between the tongue and groove becomes progressively narrower toward the open end of the groove whereby, when pressure inside the blower increases or decreases, the sealing strip is wedged more tightly in the space thereby providing a more effective seal.

The present invention, in one form thereof, comprises a plastic blower having a plastic clam shell housing and a plastic impeller. The clam shell housing is effectively sealed by providing respectively a tongue and groove on the mating edges of the clam shell sections. The tongue is loosely received in the groove and a bead of flexible sealing material is compressed in the groove by the tongue. The enclosed spaces between the walls of the tongue and of the groove converge toward the open end of the groove. Therefore the widest part of the enclosed space exists between the tip of the tongue and the bottom of the groove. As pressures within the blower housing increase or decrease relative to the ambient pressure, the sealing material is further compressed as it tends to move into the narrowest part of the enclosed space. The clam shell housing sections are held together by means of a plurality of spring clips which engage with beads located around their peripheries.

An advantage of the present invention is that the entire blower assembly is constructed of plastic material whereby the blower is able to withstand the highly corrosive exhaust gases.

A further advantage of the present invention is that the blower is lower in cost than conventional blowers because of the plastic construction and the low cost of assembly.

A still further advantage of the present invention is that the blower is effectively sealed by the self sealing structure whereby increases or decreases in pressure within the blower housing will tend to make the sealing strip wedge more tightly between the tongue and groove walls.

The present invention, in one form thereof, comprises a blower housing which includes first and second clam shell members. The clam shell members each have mating edge portions. A groove is provided in one of the edge portions, the groove having diverging walls. A tapered tongue is provided on the other edge portion. The tongue is adapted to be loosely received in the groove and the walls of the tongue and groove diverge toward the apex of the groove. A flexible strip of sealing material is disposed in the groove, the strip being in contact with and compressed by the tongue, whereby an increase or decrease of pressure in the blower housing causes the strip to be more tightly compressed between the respective walls of the tongue and groove.

The present invention, in one form thereof, provides a blower housing having first and second plastic clam shell members, each of the clam shell members including an edge portion which are adapted for mutual mating engagement. An inlet is provided in the first clam shell member. An orifice ring is provided in the housing and is secured to the first clam shell member. An outlet is provided in the housing. A motor is mounted on the housing, the motor having a rotatable shaft which extends through an aperture into the housing. A plastic blower wheel is mounted on the shaft inside the housing. A groove is provided in one of the edge portions, the groove having converging walls which end in an apex. A tapered protruding tongue is provided on the other edge and is adapted to be loosely received in the groove thereby forming a space between the tongue and the converging walls of the groove. A flexible sealing strip is compressingly retained in the space between the tongue and the groove, whereby variation of pressure within the housing with respect to the ambient pressure outside the housing causes the strip to be more tightly compressed within the space.

The present invention, in one form thereof, comprises a blower having a clam shell housing with first and second clam shell members. Each clam shell member has an edge and the respective edges have substantially flat mating surfaces. An inlet and an outlet are provided in the housing. A motor is mounted on the housing, the motor having a rotatable shaft which extends into the housing. An impeller is mounted on the shaft. One of the edges includes a generally V-shaped groove and the other edge includes a tapered protrusion thereon. The tapered protrusion is adapted to be loosely received in the groove and forms an enclosed space between the walls of the groove and the protrusion. The distance between the walls of the groove and the protrusion is greatest between the tip of the protrusion and the enclosed end of the groove and progressively decreases toward the open end of the groove. A flexible sealing strip is disposed in the enclosed space and is compressed therein by the protrusion. The mating surfaces of the edges are in intimate contact whereby an increase or decrease in the pressure of the housing causes the strip to be more tightly compressed between the respective walls of the tongue and groove.

It is an object of the present invention to provide a plastic clam shell blower housing.

It is a further object of the present invention to provide a plastic clam shell blower housing which is effectively sealed and wherein the sealing strip is actuated by pressure within the blower housing to be self sealing.

It is a further object of the present invention to provide a clam shell blower housing which is assembled without the use of threaded fasteners.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
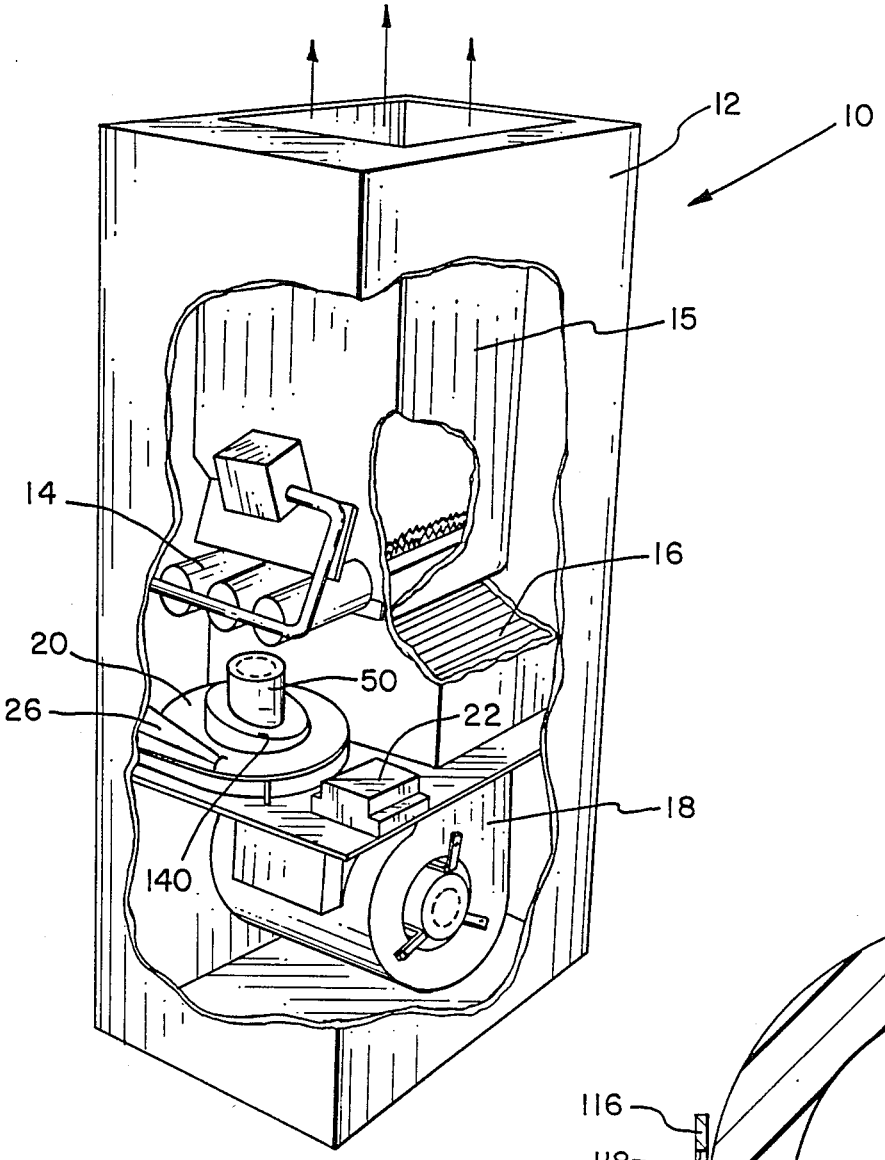
FIG. 1 is a perspective, partially broken away, view of a furnace incorporating a preferred embodiment of the present invention.

Referring to FIG. 1, there is shown a perspective, partially broken away, view of a furnace such as is commonly used in residences. The furnace 10 includes a cabinet 12 in which are housed one or more burners 14 which are fueled by natural gas or other suitable fuels. Ignition system 22 ignites the fuel when the furnace is turned on. The products of combustion are directed through one or more heat exchangers. In the disclosed embodiment two heat exchangers 15 and 16 are shown, 15 being the primary heat exchanger and 16 being the secondary heat exchanger. The air to be heated is drawn from the residence through a return duct and is blown over the heat exchangers by means of a blower shown at 18. This air is moved over the exterior of the heat exchangers after which it is exhausted through a heating duct system as shown by the arrow and is returned to the dwelling for the heating thereof. The products of combustion are drawn through the heat exchanger by means of an exhaust blower 20 which draws the products of combustion through the primary and secondary heat exchangers 15 and 16 by way of a manifold or header (not shown) and an inlet into the blower 20. The products of combustion are then routed through an outlet 26 of the blower and to a flu or vent (not shown).

Further details of construction of a furnace such as shown in FIG. 1 is provided in U.S. Pat. No. 4,542,734 entitled "High Efficiency Furnace with Secondary Heat Exchanger", which is assigned to the assignee of the present invention and which disclosure is incorporated herein by reference.

Figure 2:
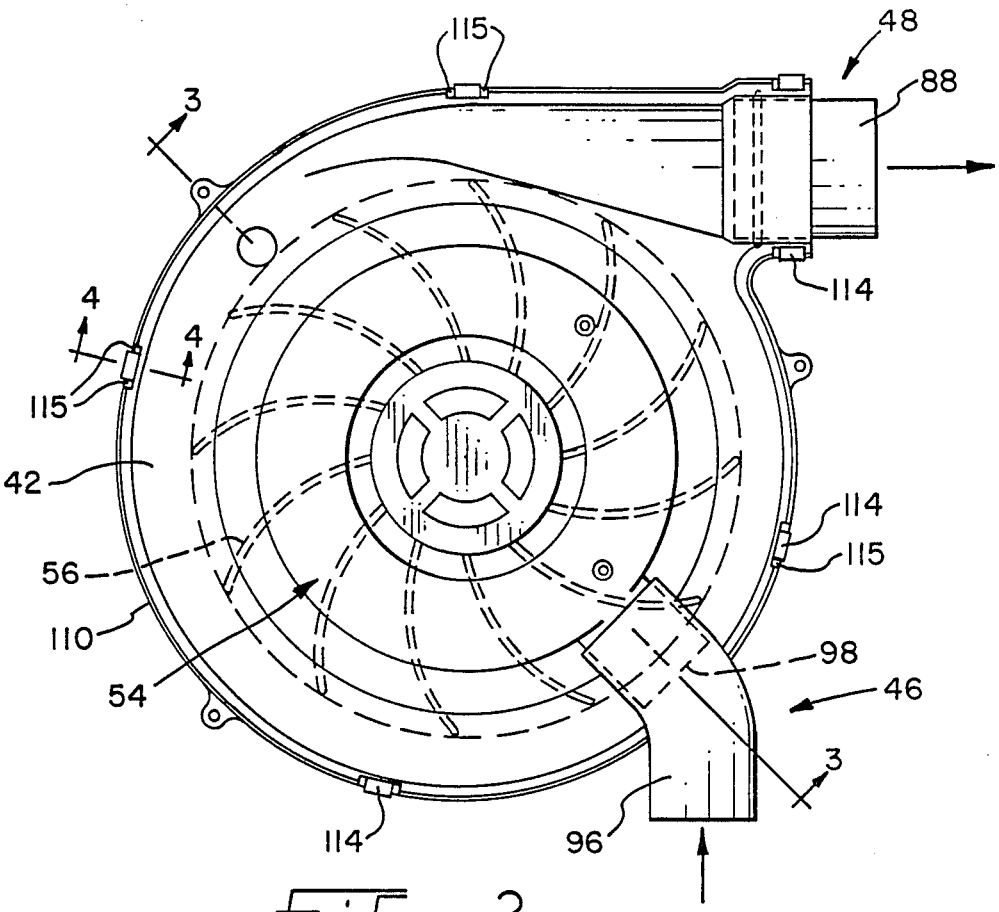
FIG. 2 is a top plan view of a blower in accordance with the present invention.
Figure 3:
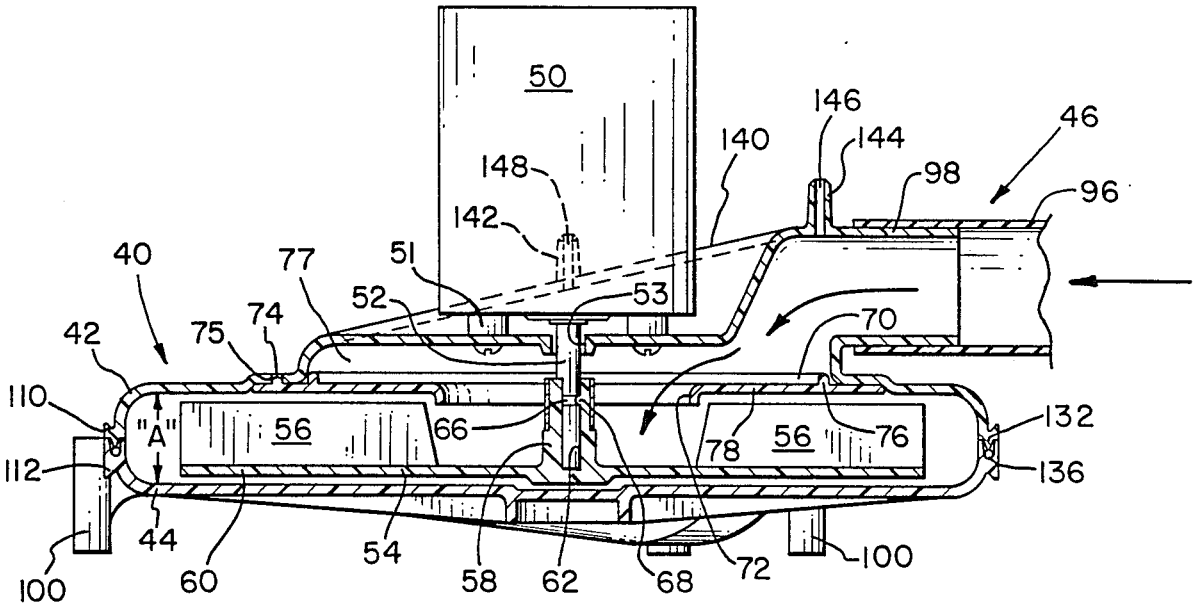
FIG. 3 is an elevational view, partially in cross-section, of the blower of FIG. 2.
Figure 5:
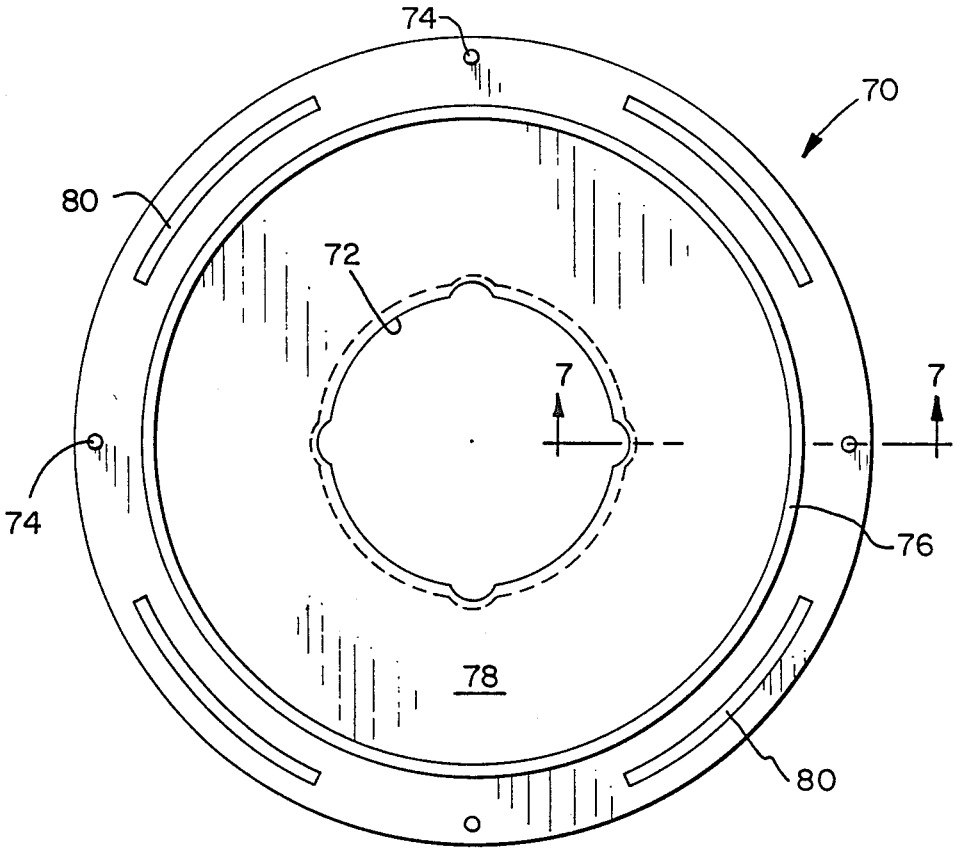
FIG. 5 is a top plan view of the orifice ring for the blower of FIG. 2.
Figure 6:
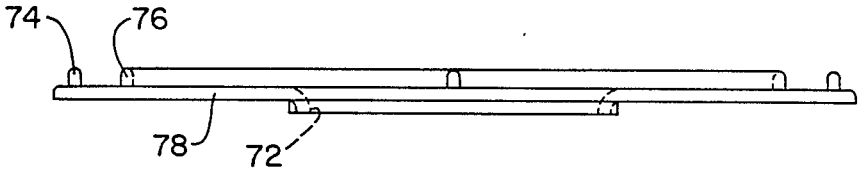
FIG. 6 is an elevational view of the orifice ring of FIG. 5.
Figure 7:
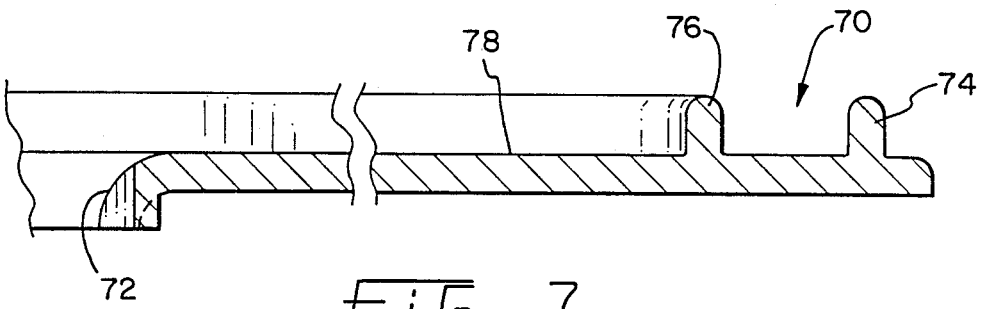
FIG. 7 is a partial broken away view, in cross-section, of the orifice ring of FIG. 7 taken along line 7—7 of FIG. 5.
Figure 8:
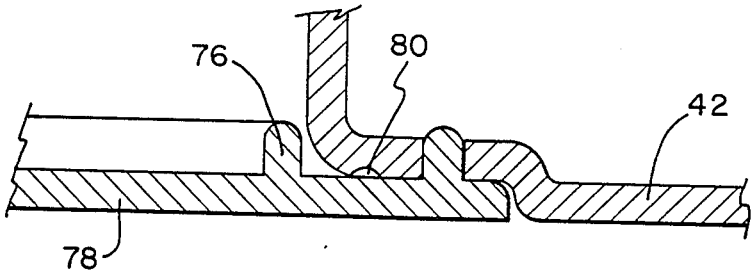
FIG. 8 is a partial broken away cross-sectional view of the orifice ring and housing assembly of the blower of FIG. 2.
Figure 11:
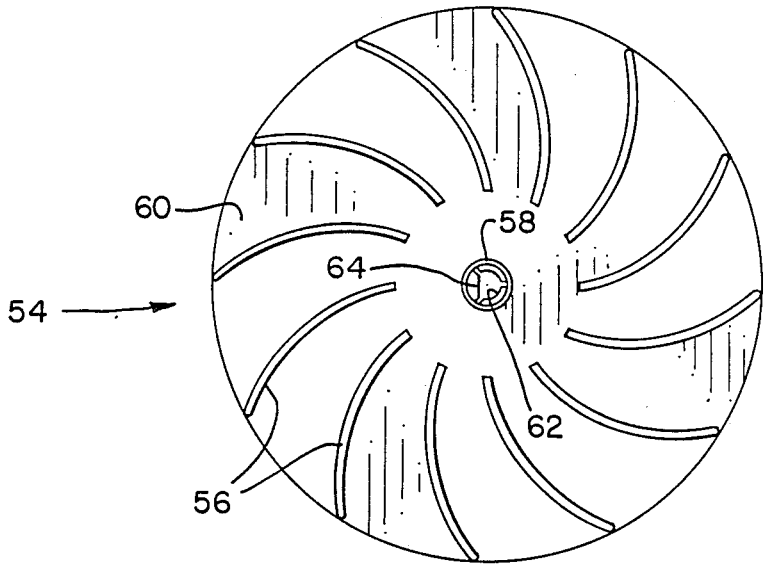
FIG. 11 is a top plan view of the impeller for the blower of FIG. 2.

Referring now to FIGS. 2 and 3, exhaust blower 20 includes a housing 40 which has a clam shell construction including clam shell members 42 and 44. The housing includes an inlet 46 for admitting products of combustion into the blower, and an outlet 48 for exhausting products of combustion from the blower. Mounted on clam shell member 42 is a motor 50 which is secured to clam shell member 42 by means of threaded fasteners indicated at 51. Motor 50 includes an output shaft 52 which extends through an aperture 53 in clam shell member 42. Mounted on shaft 52 is a blower impeller wheel 54 further illustrated in FIG. 11. The impeller 54 includes a flat disk 60, a hub 58 which is secured to motor shaft 52 and a series of curved upstanding vanes 56 which extend generally radially outwardly from the center of the disk 60 to the perimeter thereof. Hub 58, as illustrated in FIG. 11, includes an aperture 62 therein having a flat 64 for engaging with a mating flat section on motor shaft 52. By means of this arrangement impeller cannot rotate on shaft 52 but is constrained to rotate with shaft 52. Furthermore, blower impeller wheel 54 is axially secured to shaft 52 by means of a bead 68 formed inside hub aperture 62 which engages with a groove 66 in shaft 52.

For a further more complete description of the engagement of the impeller wheel 54 with shaft 52, reference should be had to co-pending patent application Ser. No. 217,402 entitled "Hub for a Plastic Blower Impeller" which is assigned to the assignee of the present invention and which was filed on even date herewith. The specification of that patent application is incorporated herein by reference.

An orifice ring 70 is mounted inside blower housing 40 as best seen in FIG. 3. Orifice ring 70 is further illustrated in FIGS. 5–8 and is seen to comprise a flat disk 78 having a circular orifice 72 therein. A circular, upstanding spacer ring 76 is provided on clam shell member 42 for locating orifice ring 70 inside clam shell member 42. Orifice ring 70 also includes a plurality of positioning studs 74 which extend through apertures 75 in clam shell member 42. The orifice ring 70 is sonic welded into clamshell member 42 by means of sonic weld ribs 80. Thus, as clearly seen in FIG. 3, products of combustion enter inlet 46 and then will travel through the space 77 between orifice ring 70 and clam shell section 42, through orifice 72 after which impeller wheel 54 will exhaust the products of combustion through outlet 48 of the blower.

It can be seen by reference to FIGS. 2, 3, 4, and 9 and as described hereinafter, that the entire perimeter of the blower housing is sealed so that the products of combustion are effectively prevented from leaking out of the blower housing. Furthermore, no products of combustion will pass through opening 53 of blower housing through which shaft 52 of motor 50 extends as the pressure in this region will be negative due to the fact that the impeller draws exhaust gas through space 77 between the orifice ring 70 and clam shell section 42.

Figure 9:
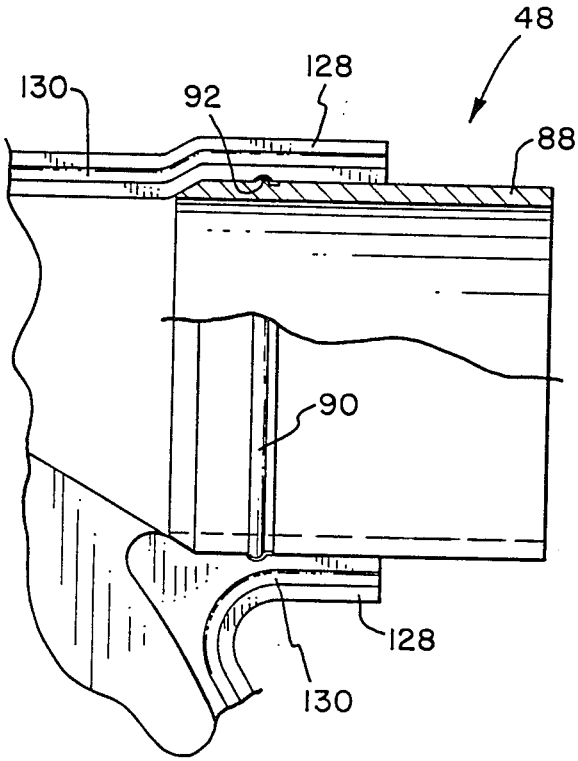
FIG. 9 is a partial broken away cross-sectional view of the exhaust outlet for the blower of FIG. 2.

As best seen in FIGS. 2 and 9, outlet 48 includes an outlet tube 88 which is held in place between clam shell members 42 and 44 by means of bead 90 on tube 88 and a groove 92 in clam shell members 42 and 44. Bead 90 may also be replaced with an "O" ring. Sealing material is placed on bead 90 to securely fasten tube 88 in the blower housing. Inlet 46 consists of an inlet pipe 98 formed integrally with clam shell member 42 onto which a resilient inlet boot 96, made for instance from rubber, is placed to connect inlet 10 with the furnace exhaust header. Feet 100 are provided on the blower housing to mount the blower housing to the furnace by means of threaded fasteners or the like.

Figure 4:
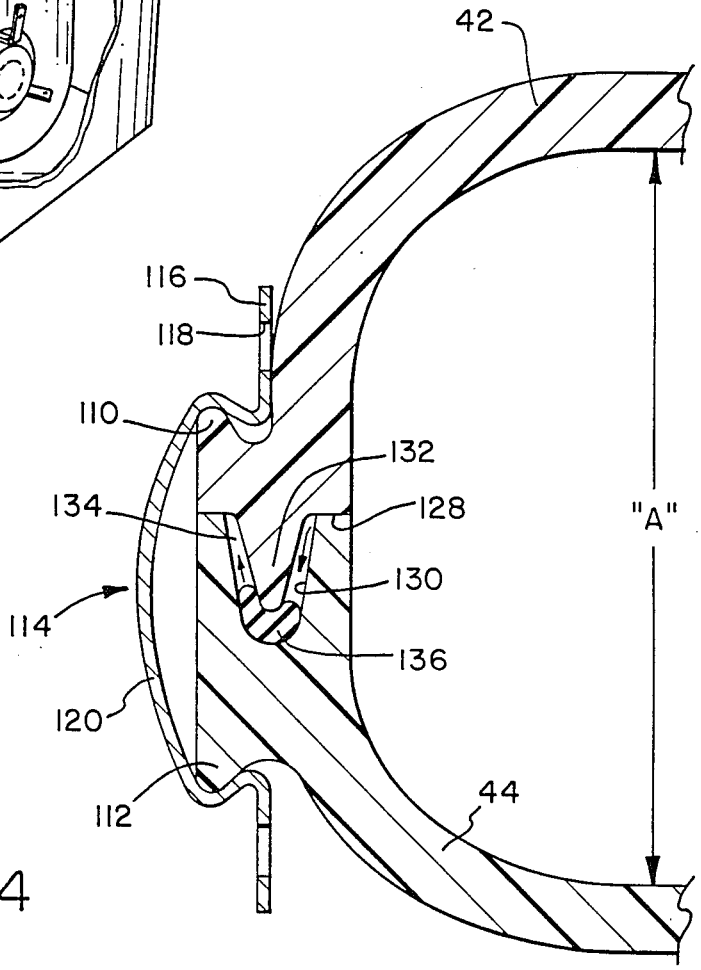
FIG. 4 is an enlarged, broken away, cross-sectional view of the sealing structure of the clam shell housing for the blower of FIG. 2.
Figure 10:
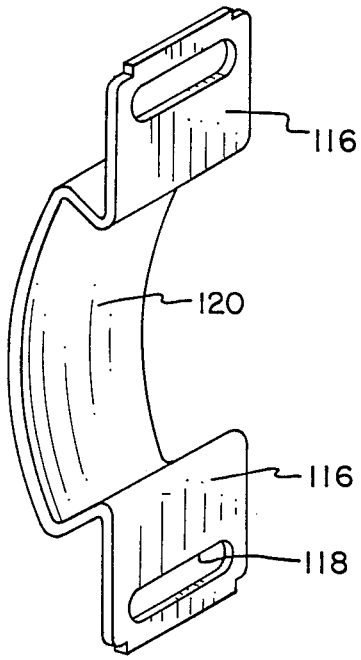
FIG. 10 is a perspective view of a clip for the blower assembly of FIG. 2.

Clam shell members 42 and 44 are sealingly connected together as best shown in FIGS. 3 and 4. Around the outside periphery of clam shell member 42 there is provided a bead 110. Around the periphery of clam shell member 44 a bead 112 is provided. As shown in FIG. 10, clips 114, which may be made of non-corroding spring steel, are provided for securing the clam shell members 42 and 44 together in positive position or displacement contact. Thus, as can be seen in FIG. 3, distance "A" is constant or fixed. Clips 114 include two flanges 116 having apertures 118 therein. Apertures 118 are provided to aid in the assembly and disassembly of clips 114 to the structure. Furthermore, flanges 116 are connected by a bight portion 120. Thus, after placing clam shell members 42 and 44 into contact, a plurality of clips 114 are snapped onto beads 110 and 112 to retain members 42 and 44 securely together. Clips 114 also are placed on both sides of outlet tube 88 to keep tube 88 securely in place. The clam shell members 42, 44, also include tabs 115 on their peripheries to locate clips 114.

The sealing structure for clam shell members 42 and 44 is best illustrated in FIG. 4. Clam shell member 42 includes a flat peripheral edge 126 for mating engagement with flat peripheral edge 28 of clam shell member 44 whereby positive displacement of the sections is provided to create a constant separation distance "A" between members 42 and 44. Edge 128 includes a v-shaped groove 130. Edge portion 126 includes an elongated tongue or protrusion 132 formed along peripheral edge 126. As can be seen in FIG. 4, tongue 132 fits loosely in groove 130. A space 134 is thereby provided between tongue 132 and groove 130 when edges 126 and 128 are in engagement as shown. In the bottom of groove 130, there is disposed an elongated strip of flexible sealing material 136, such as for instance, a round neoprene strip of rubber which is both flexible and resilient. With flat edges 126 and 128 in engagement, tongue 132 compresses bead 136 as shown in FIG. 4. It should be noted that the walls of tongue 132 and the walls of groove 130 converge toward the open end of the groove. Compression of the strip is preferably in the range of 15% to 20%. It should also be noted that normally pressure within the blower housing is in excess of ambient pressure outside the housing. Therefore, when pressure is placed on bead 136 due to leakage of gases between edges 126 and 128 from inside the blower housing, this pressure tends to press bead 136 into the narrowing space 134 and therefore tends to wedge the bead 136 more tightly into engagement with the walls of the tongue 132 and the groove 130, thereby providing a more effective seal. If for some reason the pressure inside the blower housing is lower than the ambient pressure outside the blower housing, the same self-sealing effect would be created by having the strip 136 wedge more tightly to the space 134 on the opposite side of tongue 132.

Referring now to FIGS. 1 and 3, it should be noted that section 140 of blower housing 42 is tapered. Thus, the inlet 46 is located at the area of greatest cross section of the tapered portion 140. Two pressure taps 142 and 144 are provided in sloping surface 140 at different positions thereof. The pressure taps 142 and 144 respectively include apertures 146 and 148. These pressure taps are used to provide an indication to a pressure switch that the furnace is operating properly. If it is found that pressures in the furnace blower are excessive, this may be an indication of a blocked flu or block exhaust somewhere in the system. Thus, by positioning a plurality of pressure taps on the sloping surface 140, selection of the static pressure can be obtained to meet the pressure switch requirements at different altitudes at which the furnace may be installed. Thus, for instance, if the furnace is to be installed at a high altitude such as for instance in Denver, Colo., a different pressure tap would be used than if the furnace were to be installed in Washington, D.C. The use of the sloping inlet ring cavity with the plurality of pressure taps 142, 144 thereon insures that the furnace blower need not be modified for various regions of the country and that the same pressure switch may be used for the furnace at any location.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. In a blower, a housing comprising first and second clam shell members, said clam shell members each having mating edge portions;

sealing means for sealing said housing and including a groove in an edge portion of said first clam shell member, said groove having diverging walls, a tapered tongue on the edge portion of said second clam shell member, said torque adapted to be loosely received in said groove, the respective walls of said tongue and groove forming a plurality of cavities with side walls which diverge in a direction toward the apex of said groove, a flexible strip of sealing material disposed in said groove, said strip being in contact with and compressed by said tongue, whereby an increase or decrease of pressure in said housing causes said strip to be more tightly compressed in said cavities between the respective walls of said tongue and groove.

2. The housing according to claim 1 wherein each said edge portion further includes a substantially flat surface, said substantially flat surfaces of said first and second assembled clam shell members adapted to engage each other when said tongue has compressed said strip in the range of 15% to 20%.

3. The housing according to claim 1 wherein said first and second clam shell members each include a bead along the respective edge portions, and a resilient clip simultaneously engaging said beads, for securing said clam shell members in their assembled position.

4. The housing according to claim 1 wherein said clam shell members are formed of plastic material.

5. The housing according to claim 1 wherein said strip of sealing material is formed of neoprene rubber.

6. The housing according to claim 1 including an inlet in said first clam shell member and an orifice ring secured in said first clam shell member.

7. A blower comprising:

a housing including first and second plastic clam shell members, each said clam shell members having an edge portion, said edge portions adapted for mutual mating engagement;

an inlet in said first clam shell member;

a ring orifice in said housing secured to said first clam shell member;

an outlet in said housing;

a motor mounted on said housing, said motor having a rotatable shaft extending through an aperture into said housing;

a plastic blower wheel in said housing mounted on said shaft;

a groove in one of said edge portions, said groove having converging walls ending in an apex;

a tapered, protruding tongue on said other edge and adapted to be loosely received in said groove, a space being formed between said tongue and said groove, the respective walls of said tongue and groove forming a plurality of cavities with side walls which diverge in a direction toward the apex of said groove;

a flexible sealing strip compressingly retained in the space between said tongue and groove, whereby variation of pressure within said housing with respect to the ambient pressure outside said housing causes said strip to be more tightly compressed within said cavities.

8. The housing according to claim 7 wherein each said edge portion further includes a shoulder, the shoulders of said first and second assembled clam shell members adapted for mutual engagement when said tongue has compressed said strip in said groove in the range of 15% to 20%.

9. The housing according to claim 7 wherein said first and second clam shell portions each include a bead along the respective edge portions thereof, and a plurality of resilient clips engaging the beads of said first and second clam shell members, thereby securing said clam shell members in their assembled position.

10. The blower according to claim 7 wherein said sealing strip is formed of neoprene rubber.

11. The blower according to claim 7 including an inlet in said first clam shell member, a ring orifice in said housing secured to said first clam shell member.

12. A blower comprising;

a clam shell housing having first and second clam shell members, said clam shell members having first and second edges, said edges having respective substantially flat mating surfaces;

an inlet and an outlet in said housing;

a motor mounted on said housing, said motor having rotatable shaft extending into said housing;

an impeller mounted on said shaft;

said first edge including a generally V-shaped groove;

a tapered protrusion on said second edge, said protrusion adapted to be loosely received in said groove and forming an enclosed space between the walls of said groove and said protrusion, the distance between the walls of said groove and said protrusion being greatest between the tip of said protrusion and the enclosed end of said groove, said distance progressively decreasing toward the open end of said groove;

a flexible sealing strip in said enclosed space and compressed therein by said protrusion, the mating surfaces of said edges being in intimate contact, whereby an increase or decrease in pressure in said housing causes said strip to be more tightly compressed between the respective walls of said tongue and groove.

* * * * *